US007087005B2

(12) United States Patent
Rouillard

(10) Patent No.: US 7,087,005 B2
(45) Date of Patent: Aug. 8, 2006

(54) EXERCISE STRETCH BENCH FOR BACK PAIN TREATMENT

(76) Inventor: Mark Rouillard, 221 Randall Lake Rd., Parsonfield, ME (US) 04048

( * ) Notice: Subject to any disclaimer, the term of this patent is extended or adjusted under 35 U.S.C. 154(b) by 75 days.

(21) Appl. No.: 10/404,282

(22) Filed: Apr. 2, 2003

(65) Prior Publication Data

US 2004/0198572 A1 Oct. 7, 2004

(51) Int. Cl.
*A63B 26/00* (2006.01)

(52) U.S. Cl. ..... 482/142; D21/686; D21/690

(58) Field of Classification Search ..... 482/142, 482/148, 907, 96, 140; 606/241; D21/686, D21/690; 602/32
See application file for complete search history.

(56) References Cited

U.S. PATENT DOCUMENTS 3,948,513 A * 4/1976 Pfotenhauer ..... 272/58
5,094,445 A * 3/1992 Winkelvoss ..... 482/42
5,147,259 A * 9/1992 Hutchins ..... 482/101
5,441,469 A * 8/1995 Chern ..... 482/72
5,472,401 A * 12/1995 Rouillard et al. ..... 482/142
5,542,898 A * 8/1996 Wilkinson ..... 482/142
6,458,062 B1 * 10/2002 Conner ..... 482/129
6,685,607 B1 * 2/2004 Olson ..... 482/142
2004/0192522 A1 * 9/2004 Hippensteel

* cited by examiner

*Primary Examiner*—Lori Amerson

(57) ABSTRACT

A handgrip and leg brace assembly is located over a horizontal bench portion of a stretch bench that receives and supports a user's upper torso. The handgrip is adjustable in the horizontal and vertical planes as stretching exercises are on-going and without the user leaving the bench proper. Additional bench adjustments provide an individualized height setting, and these combined adjustments allow the bench to be personalized for each given individual in order to increase the effectiveness of certain on-the-bench stretching activities.

1 Claim, 3 Drawing Sheets

EXERCISE STRETCH BENCH FOR BACK PAIN TREATMENT

BACKGROUND OF THE INVENTION

A large percentage of people experience back pain in spite of the exercise craze sweeping the country. A large proportion of the working population experience some back pain during their working careers. In particular, some back pain requires surgery that might have been avoided had a proper stretching bench and stretching routine been available.

Most of the exercise equipment currently available is not suited for relief of back pain. It is possible that some exercise could promote, rather than cure, back-pain related problems.

U.S. Pat. No. 5,472,401 entitled "Ramped, horizontal, on-bench adjustable stretch bench for relieving a user's back pain" describes a ramped and horizontal stretching bench for relieving spinal and muscle conditions contributing to back pain. A handgrip and leg brace assembly is located under the horizontal bench portion that receives and supports a user's upper torso.

U.S. Pat. No. Des.390, 664 entitled "Bench" depicts a bench arrangement having a fixed handgrip extending above the bench with a fixed leg brace extending from opposite sides thereon.

It has been determined that the provision of an adjustable handgrip and leg brace arrangement upstanding from the top surface of the exercise bench allows for a variation of back exercise actions not heretofore possible with state-of-the-art stretch benches.

One purpose of the invention is to provided a ramped and horizontal stretching bench for relieving spinal and muscle conditions contributing to back pain, and more particularly to a stretching bench that has moveable and adjustable settings for increasing the effectiveness of such relief.

SUMMARY OF THE INVENTION

A stretch bench includes a movable and height-adjustable base for a body support board having two primary body support portions. One portion is a horizontal body rest board for the user's upper torso and the other portion is a slanted knee and upper thigh rest body board. A combined handgrip and leg brace is located at the forward portion of the body support board and is adjustable both in the horizontal and vertical planes.

DESCRIPTION OF THE PREFERRED EMBODIMENT

Figure 1:
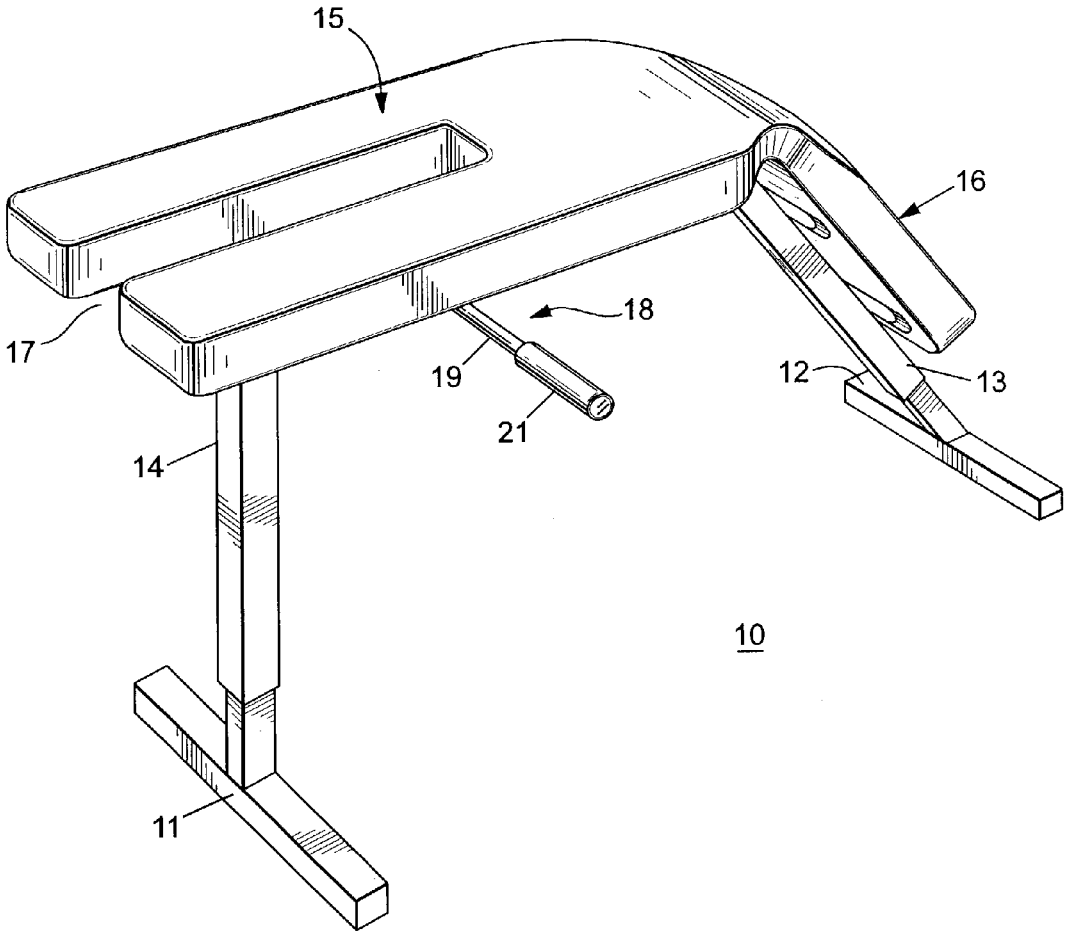
FIG. 1 (PRIOR ART)
FIG. 1 is a top perspective view of a stretch bench according to the Prior Art.

Before describing the stretch bench according to the invention, it is helpful to review a relevant stretch bench according to the prior art, as depicted in FIG. 1.

The stretch bench 10, described earlier with reference to U.S. Pat. No. 5,472,401, comprises a pair of floor supports 11, 12, which carry a corresponding pair of height-adjustable rear and front square tubes 13, 14 as indicated. A horizontal torso support board 15 connects with the front square tube 14 and a slanted knee support 16 connects with the rear square tube 13. The horizontal torso support board includes an extended slot 17 for greater movement versatility and facial comfort. A combined handgrip and leg brace 18 extends from the side of the horizontal body support 15 and includes an arm extension bar 19 and handgrip 21. A similar handgrip and leg brace (not shown) extends from the opposite side of the body support 15. The provision of a handgrip and leg brace allows for a wider range of upper body movements as well as trunk rotation.

Figure 2:
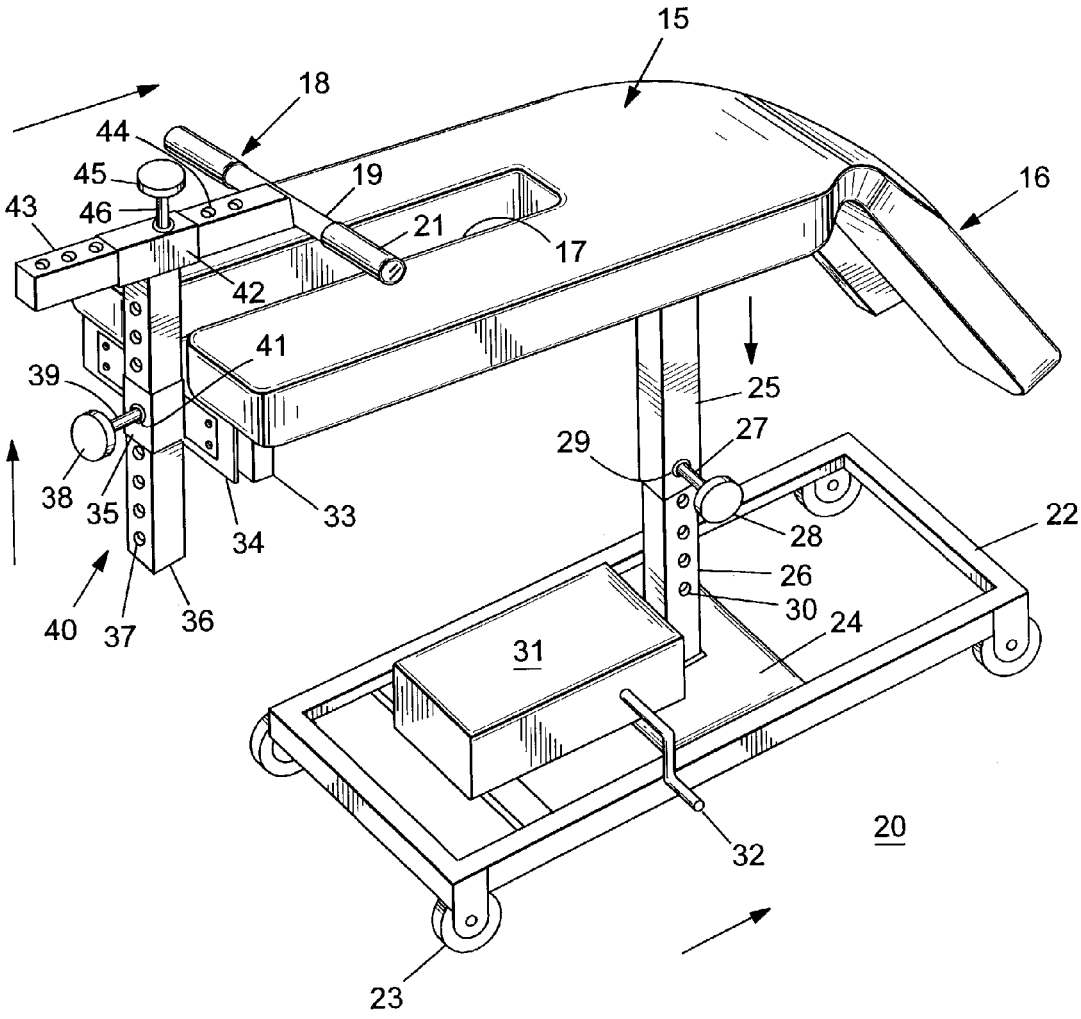
FIG. 2 is a top perspective view of the stretch bench of the invention with the handgrip and leg brace in a first position relative to the top of the bench.

The stretch bench 20, according to the invention, is shown in FIG. 2 where the horizontal torso support board 15, which includes the extended slot 17, and the separate slanted knee support board 16 are supported on the moveable platform 22 by means of the rectangular tube 25 and rectangular support bar 26. The height of the torso support board and knee support board is adjusted by means of the knob 28, post 27, which extends thru the tube 25 via the aperture 29 thru rectangular tube 25 and corresponding apertures 30 within the support bar 26. Movement of the support bar 26 relative to the support plate 24 on the platform 22 is made via the lift mechanism 31, which comprises either a hydraulic lift arrangement (not shown) or electrical drive mechanism (not shown) within the lift mechanisms 31. The movement of the support bar 26 relative to the support plate 24 to raise or lower the torso support board 15 and knee support board 16 can also be made by means of the operating handle 32. Movement of the stretch bench 20 in the indicated horizontal direction is made manually via the wheels 23.

An important feature of the invention is the handgrip and leg brace arrangement 40 on the end of the torso support 15 opposite the end defined by the knee support board 16. The arrangement 40 is attached to the torso support 15 by means of the plate 34 attached to the bar 33 on the torso support board and the first rectangular tube 35 attached to plate 34, as indicated.

The handgrip and leg brace 18 consisting of the extension bar 19 and hand grip 21 is secured to one end of the horizontal rectangular bar 43 and the other end of the horizontal rectangular bar extends thru a second rectangular tube 42. Movement in the horizontal plane, as indicated, is obtained by pulling the knob 45 to remove the post 46, which extends thru the second rectangular tube 42 out from one of the apertures 44 on the horizontal rectangular bar 43 and sliding the horizontal rectangular bar in either direction. The horizontal rectangular bar is locked in the selected position by moving the knob 45 and post 46 back within the horizontal rectangular tube to allow insertion of the post 46 within a selected one of the apertures 44.

The handgrip and leg brace 18 is moved in the vertical plane, as indicated, by pulling the knob 38 to remove the post 39 which extends thru the first rectangular tube 35 via aperture 41, out from one of the apertures 37 on the vertical rectangular bar 36 and sliding the vertical rectangular bar in either direction. The vertical rectangular bar is locked in the selected position by moving the knob 38 and post 39 back within the vertical rectangular tube to allow insertion of the post 39 within a selected one of the apertures 37.

The location of the handgrip and leg brace 18 above the torso support board 15 allows the user to make the necessary adjustments while on the torso support board for precise and accurate positioning thereof.

Figure 3:
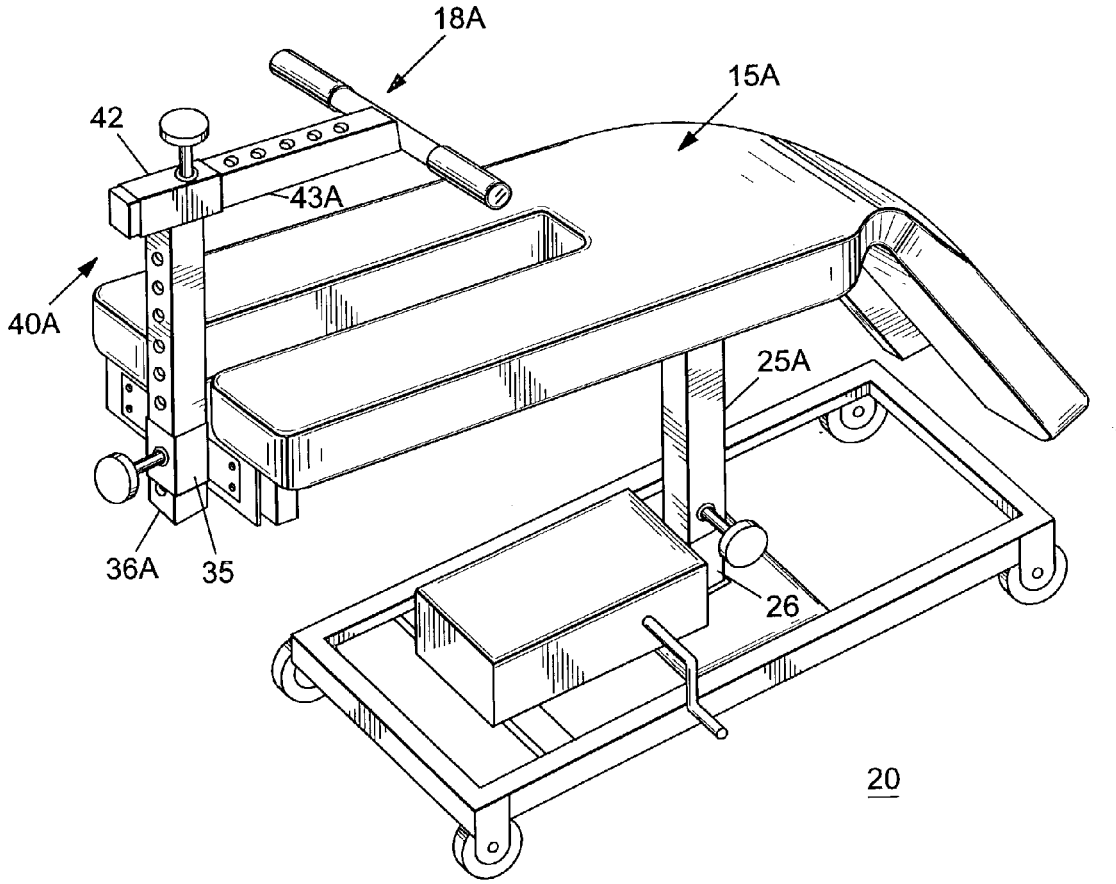
FIG. 3 is a top perspective view of the stretch bench of the invention with the handgrip and leg brace in a second position relative to the top of the bench.

The stretch bench 20 is now shown in FIG. 3 with the torso support indicated at 15A a lower position relative to that shown earlier at 15 in FIG. 2 with the rectangular tube

25A at lower position relative to the rectangular support bar 26. The leg brace arrangement 40A is extended in the horizontal and vertical directions via movement of the vertical rectangular bar 36A relative to the first rectangular tube 35 and the movement of the horizontal rectangular bar 43A relative to the second rectangular tube 42.

What is claimed is:

1. An adjustable horizontal exercise stretch bench for relieving spinal and muscle conditions contributing to back pain comprising:

a support platform having a set of wheels for movement of said platform in a horizontal plane, a torso support board and a knee support board movably attached to said support platform, said torso support board and said knee support board extending in a horizontal plane above said support platform, where said knee support board depends downwardly at an angle from one end of said torso support board, means for moving, in a vertical plane, said torso support board and said knee support board relative to said support platform, said means for moving extending downwardly from a bottom surface of said torso support board and extending upwardly from a top surface of said support platform, a handgrip extending above said support board, said handgrip including means for extension in a vertical plane, said means for extension in a vertical plane comprising a first hollow square tube attached to a front side of a rectangular support plate at a first end of said torso support board opposite said knee support board, said support plate is attached at a second side to a rectangular support bar at said end of said torso support board opposite said knee support board, a first apertured post slidably engages said first hollow tube, said handgrip further including means for extension in a horizontal plane, said means for extension in a horizontal plane comprising a second hollow square tube attached to a top end of said first apertured post and a second apertured post slidably engaging said second hollow square tube, said handgrip further includes a gripper bar and a leg brace attached to one end of said second apertured post, said gripper bar and said leg brace having hand grips on opposing ends thereof, a plurality of posts for selectively engaging said apertured posts.

* * * * *